US007235734B2

(12) United States Patent
Hosler

(10) Patent No.: US 7,235,734 B2
(45) Date of Patent: Jun. 26, 2007

(54) SENSOR ARRAY FOR A MUSICAL INSTRUMENT

(75) Inventor: David Hosler, El Cajon, CA (US)

(73) Assignee: Taylor-Listug, Inc., El Cajon, CA (US)

( * ) Notice: Subject to any disclaimer, the term of this patent is extended or adjusted under 35 U.S.C. 154(b) by 129 days.

(21) Appl. No.: 10/738,285

(22) Filed: Dec. 16, 2003

(65) Prior Publication Data

US 2005/0126375 A1 Jun. 16, 2005

(51) Int. Cl.
*G10H 3/14* (2006.01)

(52) U.S. Cl. ..... 84/725; 84/726

(58) Field of Classification Search ..... 84/723–734; 381/413

See application file for complete search history.

(56) References Cited

U.S. PATENT DOCUMENTS

| | | | | |
|---|---|---|---|---|
| 3,538,232 | A | 11/1970 | Bachtig et al. | |
| 3,624,264 | A | 11/1971 | Lazarus | |
| 3,668,295 | A | 6/1972 | Broussard | |
| 3,733,425 | A | 5/1973 | Chaki | |
| 3,992,972 | A | 11/1976 | Rickard | |
| 4,501,186 | A * | 2/1985 | Ikuma | 84/726 |
| 4,632,002 | A * | 12/1986 | Clevinger | 84/731 |
| 4,941,389 | A | 7/1990 | Wendler | |
| 5,276,276 | A * | 1/1994 | Gunn | 84/725 |
| 5,376,754 | A | 12/1994 | Stich | |
| 5,552,562 | A * | 9/1996 | Hertz et al. | 84/726 |
| 5,898,121 | A | 4/1999 | Riboloff | |
| 6,627,808 | B1 * | 9/2003 | Coats et al. | 84/723 |
| 2004/0025676 | A1 * | 2/2004 | Shadd | 84/743 |

OTHER PUBLICATIONS http://www.harmony-central.com/Guitar/Data3/Pickup_The_World/27-01.html□□Viewed online Dec. 5, 2005. Harmony Central website.* http://www.italway.it/morrone/jml-wechter%20on%20jml.htm□□Viewed online Dec. 5, 2005. □□*

* cited by examiner

*Primary Examiner*—Lincoln Donovan
*Assistant Examiner*—David S. Warren
(74) *Attorney, Agent, or Firm*—Peter K. Hahn; Luce, Forward, Hamilton & Scripps

(57) ABSTRACT

The present invention provides a sensor array for detecting vibrations from a hollow-bodied musical instrument and converting the vibrations into electrical signals for amplification. The sensor array includes a plurality of sensors connected in series including a string sensor disposed under the strings of the musical instrument and at least one body sensor attached to the soundboard of the musical instrument.

47 Claims, 7 Drawing Sheets

SENSOR ARRAY FOR A MUSICAL INSTRUMENT

FIELD OF THE INVENTION

The present invention is directed to acoustic-magnetic sensors, and more particularly to an array of acoustic-magnetic sensors providing vibrational amplification for a musical instrument, such as a guitar.

BACKGROUND OF THE INVENTION

It has long been recognized that electrical current will induce a magnetic field, and that a moving magnetic field can induce current, or changes in the magnitude of a pre-existing current. One conventional application of this phenomenon is the transducer for converting between current and vibration. More particularly, a transducer for converting between vibration and current can: (1) convert linear mechanical vibration (e.g., acoustic vibration) into a pattern of variations in electrical current; and/or (2) convert variations in a current into vibration. Such a transducer can be used to produce electrical signals from the vibrations of a musical instrument, such as a guitar.

In a guitar, taut strings are vibrated to induce acoustic vibrations in the guitar body and the air surrounding the guitar. A transducer is fixed to some part of the guitar. The vibrations of the guitar induce relative vibration between a coil and a permanent magnet in the transducer. This induced relative vibration causes current patterns in the coil. The current in the coil is usually amplified and sent to a speaker to produce louder and better-directed sound corresponding to the vibration of the guitar.

A variety of transducers have been used to convert the vibrations of a guitar into electrical current patterns. One common type involves the use of one or more piezoelectric crystals. However, such transducers suffer from a number of known drawbacks. One drawback is that piezocrystals typically require an outside power source a baseline current to operate effectively. In addition, piezocrystals tend to produce an unattractive sound distortion that is especially problematic when amplified.

Some guitars, such as disclosed in U.S. Pat. No. 5,898,121, employ string sensors or pickups, which are disposed generally beneath the strings and are adapted to convert the vibrational energy from the strings into electrical signals that can be amplified. Other guitars, such as disclosed in U.S. Pat. No. 3,624,264, use body sensors attached to the guitar soundboard to translate the motion of the soundboard into electrical signals. However, none of these guitars employ a plurality of sensors connected in series for picking up vibrational energy at different locations on the guitar and converting the combined vibrational energy into electrical signals.

In view of the above, there exists a need for a musical instrument including an array of sensors connected in series for picking up vibrational energy at different locations on the musical instrument and converting the combined vibrational energy into electrical signals for amplification. In addition, it would be desirable that the musical instrument employ sensors that do not produce distorted sounds like those associated with the use of piezocrystals.

SUMMARY OF THE INVENTION

The present invention provides a sensor array including a plurality if sensors for detecting vibrations from a hollow-bodied musical instrument, such as an acoustic guitar, and converting the vibrations into electrical signals for amplification. More particularly, the sensor array includes a string sensor disposed generally beneath the strings of the musical instrument and body sensors attached to the musical instrument soundboard. Advantageously, the sensors used in the sensor array are do not employ piezocrystals that tend to distort the natural sound of the musical instrument.

One aspect of the present invention involves a sensor array for a musical instrument including a string sensor disposed under the strings of the musical instrument and at least one body sensor attached to the soundboard of the musical instrument. The string sensor and at least on body sensor are connected in series by a lead. Preferably, the body sensors are attached to the soundboard at distinct locations and are substantially oriented in a single direction. The placement of the at least one body sensor should preferably take advantage of the natural phase relationship of the soundboard such that each body sensor is attached adjacent a hot spot. The hot spots can be determined by the process of trial and error. Optionally, the body sensors are attached to an interior surface of the soundboard such that they are substantially hidden from view during use of the musical instrument.

Another aspect of the present invention involves a sensor array for a musical instrument including a string sensor disposed under the strings of the musical instrument and at least one body sensor attached to the soundboard of the musical instrument, wherein each body sensor is an electromagnetic transducer including a housing, a coil, a permanent magnet and a diaphragm. The housing is preferably filled with damping fluid which damps external vibrations that cause the magnet to vibrate. In addition, the housing includes a bobbin portion that constrains the coil to the housing. Preferably, the magnet is substantially cylindrical and includes a central longitudinal axis and poles that are disposed substantially symmetrically about the central longitudinal axis. The diaphragm is a thin disk-shaped leaf spring connected to one end of the magnet and comprising a first end portion and a second end portion, whereby displacement of the second end portion away from the first end portion in a linear direction along a linear axis will tend to cause the second end portion to rotate with respect to the first end portion about a rotational axis. This permits the magnet to vibrate both linearly and rotationally within the housing.

An additional aspect of the present invention involves a sensor array for a musical instrument including a string sensor disposed under the strings of the musical instrument and at least one body sensor attached to the soundboard of the musical instrument, wherein the string sensor is an electromagnetic pickup including a bobbin, a coil wound around the bobbin and at least one permanent magnet coupled to the bobbin. Each magnet is preferably a substantially cylindrical pole piece disposed adjacent a respective musical instrument string. Optionally, the string sensor may further comprise an elongate metal bar embedded within the bobbin.

A further aspect of the present invention involves a sensor array for a musical instrument including a plurality of sensors connected in series, attached to the soundboard and oriented substantially in a single direction. The musical instrument is optionally a guitar.

Yet another aspect of the present invention involves a sensor array for a musical instrument including a plurality of sensors connected in series and attached at distinct locations on the soundboard. Preferably, the sensors are powered by energy created by the movement of the strings and soundboard such that an external power source is unnecessary. According to some embodiments, the plurality of sensors comprises a plurality of body sensors attached to the soundboard. According to other embodiments, the plurality of sensors comprises a plurality of string sensors disposed substantially adjacent the strings.

These and other features and advantages of the present invention will be appreciated from review of the following detailed description of the invention, along with the accompanying figures in which like reference numerals refer to like parts throughout.

BRIEF DESCRIPTION OF THE DRAWINGS

FIG. 8A is a schematic wiring diagram depicting a string sensor and a pair of body sensors coupled in series by a lead, while

DETAILED DESCRIPTION

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

Preferred Body Sensor Suitable for use with Electromagnetic Sensor Array

Figure 1:
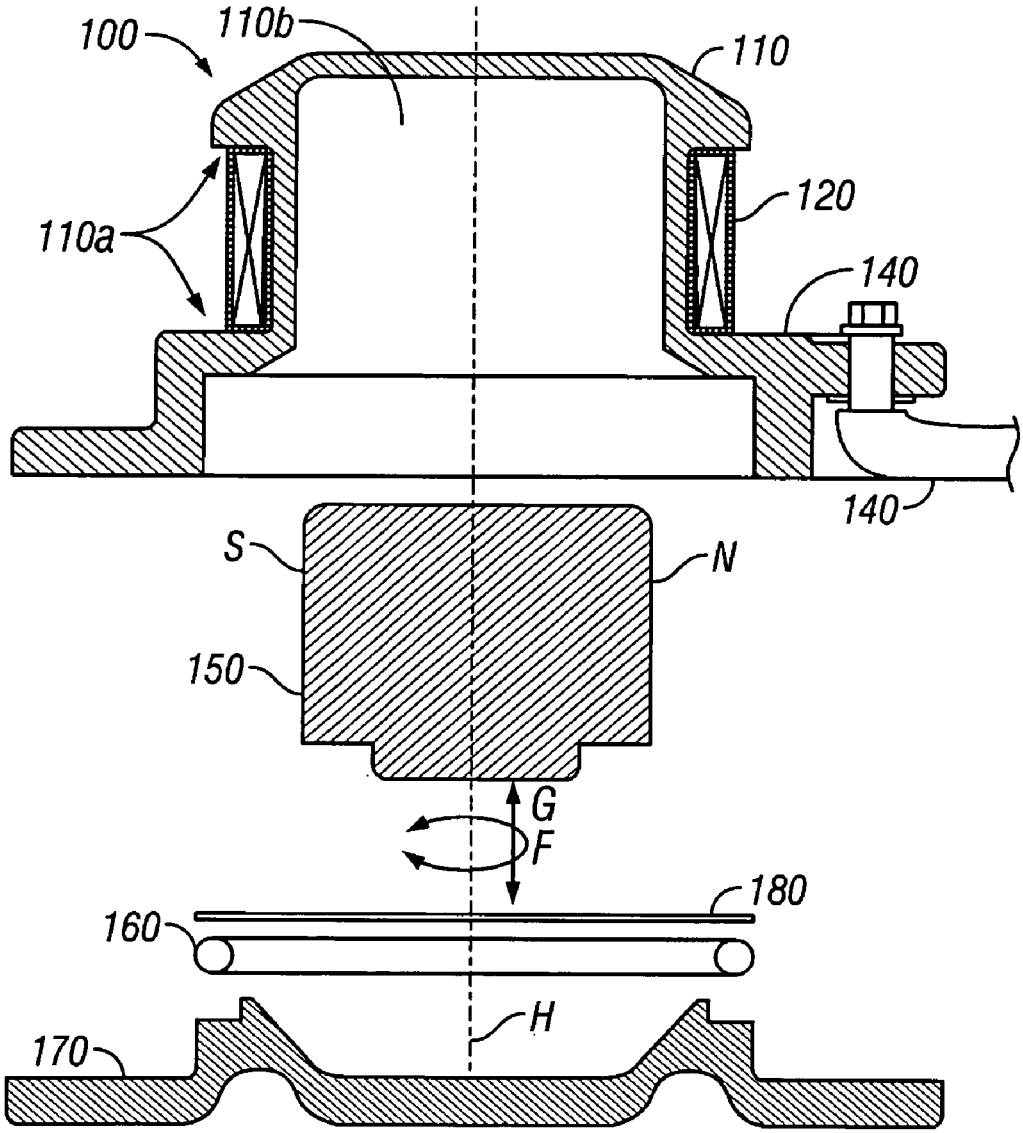
FIG. 1 is an exploded cross-sectional view of a body sensor suitable for use in a sensor array for a musical instrument in accordance with the principles of the present invention.
Figure 2:
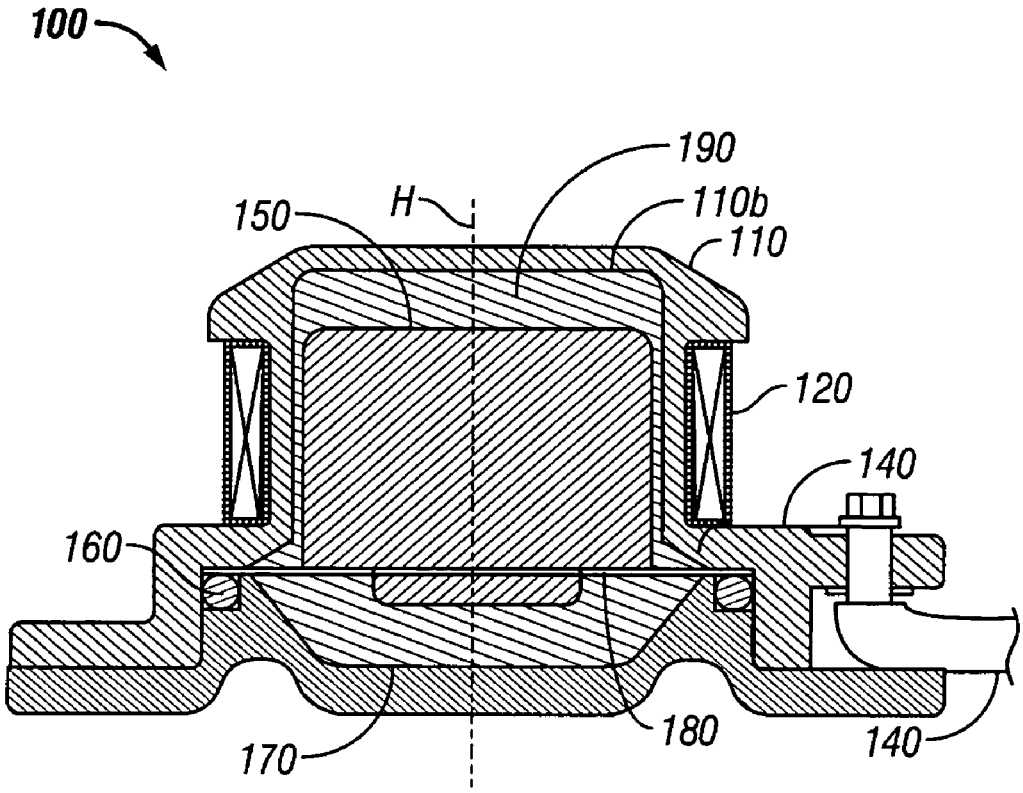
FIG. 2 is a non-exploded cross-sectional view of the body sensor of FIG. 1.
Figure 3:
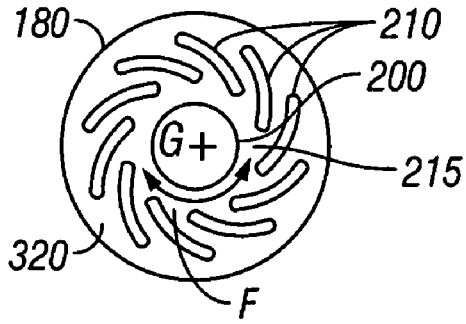
FIG. 3 is a top plan view of an embodiment of a diaphragm for the body sensor of FIG. 1.

A preferred body sensor 100 suitable for use in a sensor array for a musical instrument in accordance with the principles of the present invention will now be described with reference to FIGS. 1-4. FIG. 1 shows an exploded cross-sectional view of body sensor 100, which is preferably an electromagnetic transducer including housing 110, coil 120, lead 140, permanent magnet 150, gasket 160, cap 170 and leaf spring diaphragm 180. FIG. 2 is a cross-sectional view showing body sensor 100 in its assembled state.

As best seen in FIG. 2, housing 110 is substantially liquid tight such that it holds damping liquid 190 within its interior space. Preferably, damping liquid 190 substantially fills housing 110 so that it will always surround the moving components within the housing, regardless of the orientation of the housing with respect to the gravitational field. The damping liquid damps external vibrations that tend to cause permanent magnet 150 to vibrate. Housing 110 includes a bobbin portion 110*a* and an interior cavity 110*b*. The bobbin portion is a spool that constrains coil 120 to the housing. The cavity potion 110*b* accommodates vibrating magnet 150. The material selected for housing 110 should provide any necessary damping and shielding, but it should be kept in mind that the need for damping may be limited because of damping liquid 190. Suitable materials for housing 110 include acetyl resin, ABS plastic, DELRINA and other plastics.

Coil 120 is an electric signal carrier that is coil shaped. It is common to use coil shaped carriers in electromagnetic transducers because this geometry allows a long length of current carrier to be in close proximity to a moving magnetic field that is centered within the coil. In this embodiment, permanent magnet 150 vibrates relative to housing 110 and coil 120. Of course, the design can be varied so that the coil vibrates relative to the housing in addition to or instead of the magnet without departing from the scope of the present invention.

As shown by reference characters "N" and "S" in FIG. 1, permanent magnet 150 is cylindrical and is constructed to have one south pole and one north pole disposed symmetrically about the central axis H of the cylindrical magnet. This polar orientation of magnet 150 is preferable because it takes advantage of linear and rotational aspects of the vibration. Of course, permanent magnet 150 may have different shapes and polar orientations without departing from the scope of the present invention. As will now be discussed, leaf spring diaphragm 180 is used to convert linear vibrational motion into a more complex vibrational motion that has both linear and rotational components.

Leaf spring diaphragm 180 is a thin disk-shaped leaf spring having a central aperture 200 and a set of curved, elongated apertures 210 defined therein. Referring to FIG. 1, assume that the outer periphery of the disk 180 is fixed, while the inner periphery can be displaced into and out of the plane of the page in the direction indicated by cross G. When this happens, the inner periphery of disk 180 will rotate (or twist) relative to the fixed outer periphery in the direction indicated by arrow F. This is due to the geometry of the curved, elongated apertures 210, which help the transducer pick up lateral movement providing a more accurate reading of the movement of the musical instrument.

When the leaf spring vibrates in a linear direction, normal to its major surfaces, the inner periphery will also be rotating about the center axis of the disk over some range of angles. More particularly, permanent magnet 150 is fixed to central aperture 200 of leaf spring diaphragm 180 such that the magnet moves with the inner periphery 215 of leaf spring diaphragm 180 as leaf spring diaphragm 180 is driven to vibrate with external vibration. As shown in FIG. 1, external vibrations cause the inner periphery of leaf spring diaphragm 180 to vibrate linearly in the direction of arrow G and also to vibrate rotationally in the direction of arrow F.

This means that magnet 150 will also vibrate both linearly and rotationally. Leaf spring diaphragm 180 is preferably made of a polyester film, such as MYLAR, so that it will be strong and elastic.

Both the linear and rotational aspects of the vibration of magnet 150 will tend to induce current changes in coil 120. The strength of the induced electrical signal will correspond with the vector sum of the linear vibration (which is motion substantially normal to the direction of the current in the coil) and the normal component of the rotational vibration. By aligning the poles about central axis H, rather than along the central axis, this vector sum is maximized. This will provide the strongest output electrical signal for a given magnitude of input mechanical vibration.

Lead 140 provides a path for the electric signal (e.g., electrical current) induced in coil 120 to get to external components such as an amplifier and speaker. In this embodiment, there is only one lead because there is no "baseline" current or voltage that is externally supplied to coil 120. Advantageously, the entire electrical signal is the result of induction from the moving magnetic field such that an external power source is not required.

Permanent magnet 150 may be constructed as a conventional permanent magnet. Preferably, developing material technologies, such as bonded neodymium powder magnets, make possible: (1) more powerful magnets; and (2) new magnet geometries. For example, it may be or become possible to make a cylindrical magnet with 2 north poles and 2 south poles alternating about the central axis. It may be possible to make a magnet with even more than 4 total poles distributed in an alternating fashion around the central axis. Such magnets would be especially useful in conjunction with the rotating vibration aspect of the present invention because these multi-pole magnets would have a more sharply varying magnetic field as taken in the angular direction of the coil. The rotation (that is, angular motion in direction F) of such a cylindrical magnet then sets into motion this magnetic field so that there is more interplay between the coil and the relatively moving magnetic field. The resultant electric signal induced in the coil would tend to be stronger and also would tend to have a different quality than a conventional linear motion transducer.

Damping fluid 190 is put into cavity portion 110*b* of housing 110 when the body sensor is assembled. More particularly, the damping fluid and the magnet/leaf spring assembly are inserted into the cavity. Then, gasket 160 and cap 170 are secured over housing 110 and the outer periphery portion 220 of leaf spring diaphragm 180. For example, cap 170 can be secured with an adhesive or by an interference fit with housing 110. Gasket 160 is preferably formed as an elastic O-ring. Gasket 160 seals the juncture between cavity 110*b* and cap 170 so that damping fluid does not leak out of the body sensor.

Damping fluid 190 is preferably shock absorber fluid or hydraulic fluid. The degree of damping will depend on the viscosity of the damping liquid. The viscosity of the damping liquid, in turn, will depend on the identity of the damping liquid and also upon temperature. The damping fluid should be chosen to have an optimal viscosity based on the results that are sought. If the body sensor is used to transduce acoustic vibrations of a musical instrument, then the damping liquid should be chosen based on the sound that is generated based on the electric signal from the body sensor.

Preferably, the damping liquid should not freeze in normal use. Also, for electromagnetic transducers, the damping liquid must have some magnetic permeability to allow electromagnetic interaction between the electric signal carrier and the magnetic member. Preferably, the damping liquid will not corrode the magnetic member, springs or other hardware into which it comes in contact. Other oils are also preferred as damping liquids because of the range of viscosities and low freezing points of oil-based liquids.

One advantage of the body sensor 100 is its small size (less than an inch around, less than an inch high). The small size is largely the result of the efficiency of converting external vibrations to both linear and rotational vibration. The rotational aspect allows more relative motion between the magnetic field and the coil, without substantially increasing the size of the body sensor. Because the body sensor is so small it will tend to have a good high frequency response, which makes it good for transducing the acoustic vibrations of musical instruments. Also, the small size of the body sensor keeps it from being a significant vibrational load even when it is attached to the source of a musical instrument.

The sinusoidal, vector sum characteristics of a body sensor with rotational motion make it difficult to analytically predict what body sensor will perform best for a musical instrument. Springs, like spring 180, can be designed to provide more or less rotational displacement per unit linear displacement. The balance between linear vibration and rotational vibration is a design variable that should be optimized for a given application or audience. Different body sensors should be tried and their respective output signal should be compared by ear and/or by software, so that the output signal will have the best characteristics (e.g., audio characteristics) for the job at hand.

Figure 4:
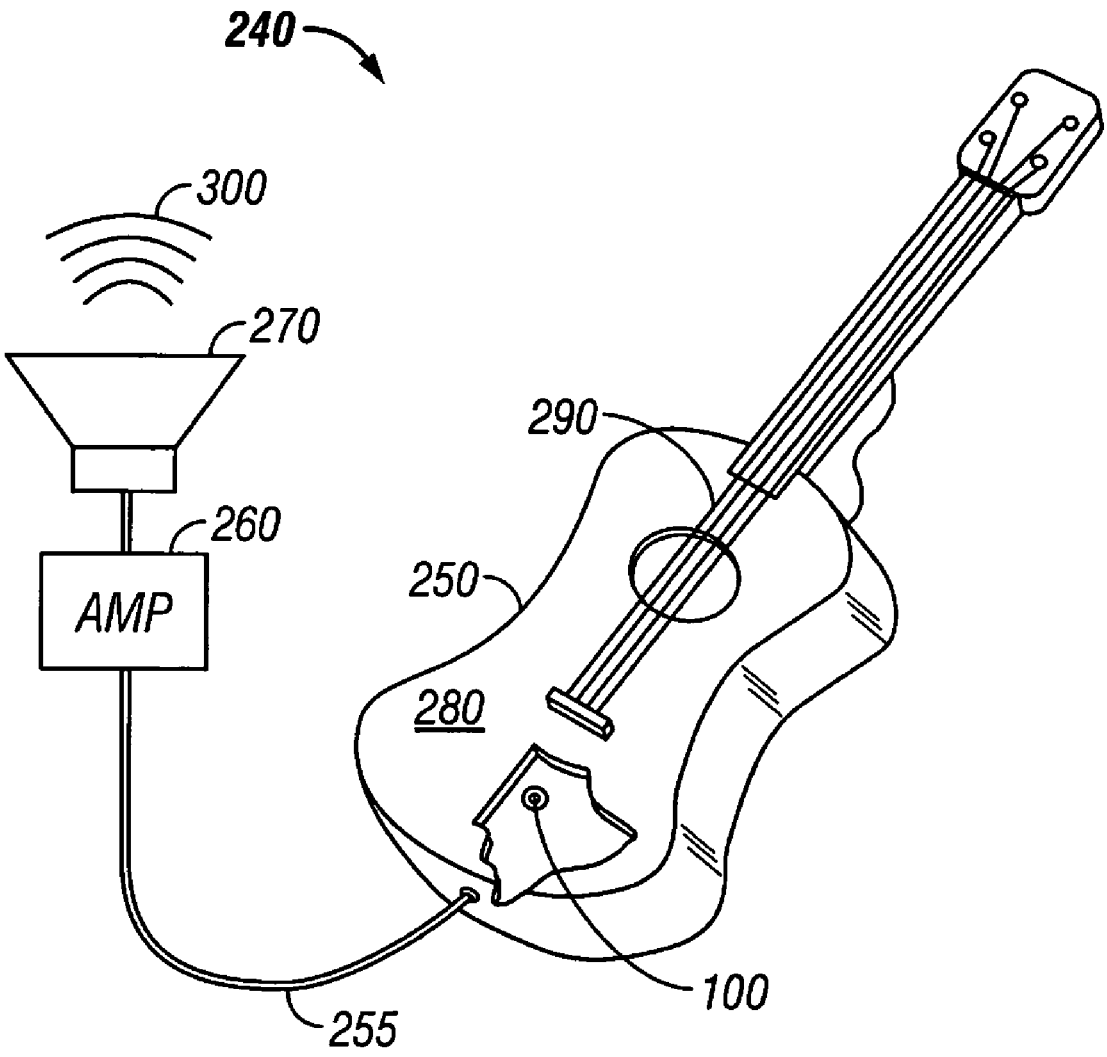
FIG. 4 is a cutaway view of a musical instrument including the body sensor of FIG. 1.

FIG. 4 shows musical instrument assembly 240 including an acoustic guitar 250, body sensor 100, lead 255, amplifier 260 and speaker 270. As shown in FIG. 4, the body sensor 100 is merely attached to a surface of the musical instrument. In the illustrated embodiment, the body sensor is attached to an inner surface of the soundboard 280 of acoustic guitar 250. The body sensor is preferably attached by adhesive, but may alternatively be attached using conventional fasteners such as screws, nails, bolts, rivets or hook and loop fasteners. The placement of the body sensor on the musical instrument may affect the frequency distribution and/or magnitude of the acoustic vibrations that are received. Therefore, some trial and error may be needed to optimally place the body sensor on the acoustic guitar.

Strings 290 of the acoustic guitar are vibrated by plucking or strumming or the like. This causes the entire body of acoustic guitar 250 to vibrate. This vibration will be communicated through the air and through the guitar body to the body sensor. As explained above, this external vibration may be dampened by the body sensor housing and/or by damping liquid. Also, the vibration may be converted, in whole or in part, to a rotational vibration in the body sensor.

The electric signal transduced in the body sensor is sent by lead 255 out to amplifier 260. Amplifier 260 is preferably a standard amplifier for amplifying musical instruments based on a signal from a body sensor. An amplified signal is then sent to speaker 270 where it is transduced back into sound 300. The body sensor that transduces the signal back into sound may or may not employ liquid damping or rotational vibration.

Preferred String Sensor Suitable for use with Electromagnetic Sensor Array

A preferred electromagnetic string sensor 310 suitable for use in a sensor array for a string musical instrument in accordance with the principles of the present invention will now be described with reference to FIGS. 5-7.

Figure 5A:
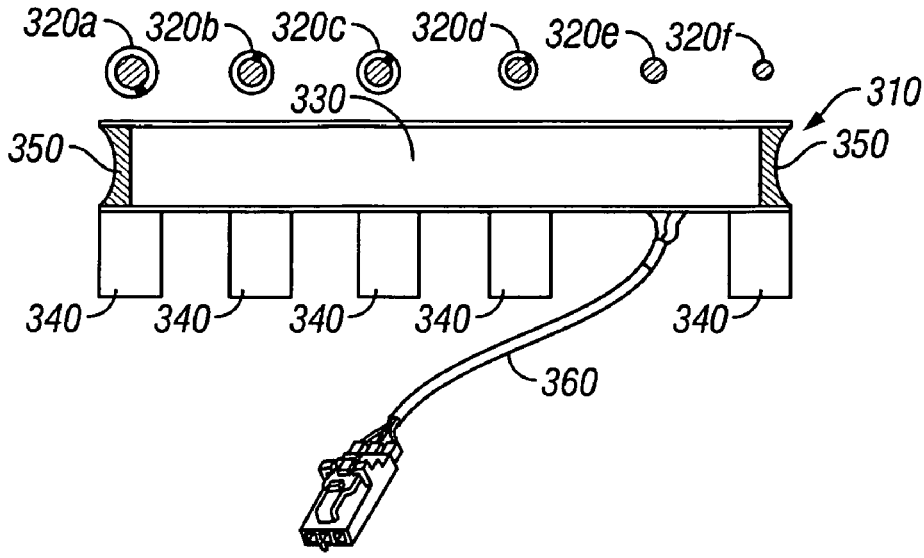
FIGS. 5A and 5B are cross-sectional and perspective views, respectively, of a string sensor suitable for use in a sensor array for a musical instrument in accordance with the principles of the present invention.
Figure 5B:
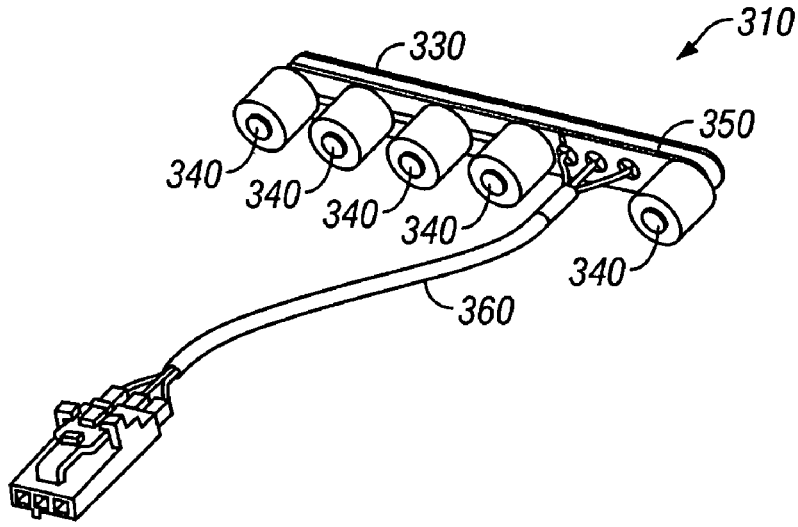

FIGS. 5A and 5B show string sensor 310 disposed adjacent strings 320*a-f*. String sensor comprises a bobbin 330 and at least one pole piece 340 coupled thereto. Each pole piece 340 is preferably a permanent magnet disposed substantially adjacent a respective guitar string 320*a-f*. In the illustrated embodiment, string sensor 310 includes five cylindrical pole pieces 340 corresponding to strings 320*a-d,f*. Of course, as will be appreciated by those of skill in the musical arts, the pole pieces 310 may be shapes other than cylindrical without departing from the scope of the present invention. Bobbin 330 is preferably made from a durable plastic material such as LEXAN.

The guitar strings 320 have varying degrees of magnetization due to differences in string materials and diameters such that sounds produced by high strings 320*d-f* are normally more dominant than those produced by low strings 320*a-c*. To provide a natural tone while achieving a balanced response from each string, high string 320*e* preferably does not have an associated pole piece. However, according to other embodiments, string 320*e* may have associated pole piece that has been modified to produce a varying magnetic field in accordance with the relative maintainability of string 320*e*. By way of example, string 320*e* may have an associated pole piece that is smaller in size than the other pole pieces 340. Alternatively, string 320*e* may have a pole piece that is further spaced apart from the bobbin 330.

String sensor 310 further comprises a coil 350 wound many times around bobbin 330. In operation, the vibration of strings 320 causes changes in the magnetic fields of the pole pieces 340, which in turn induces current in the coil 350. The induced current is then fed to conventional amplifying equipment through lead wires 360. In this manner, a string musical instrument can be electronically amplified while retaining the natural tone quality of the strings 320.

Figure 6:
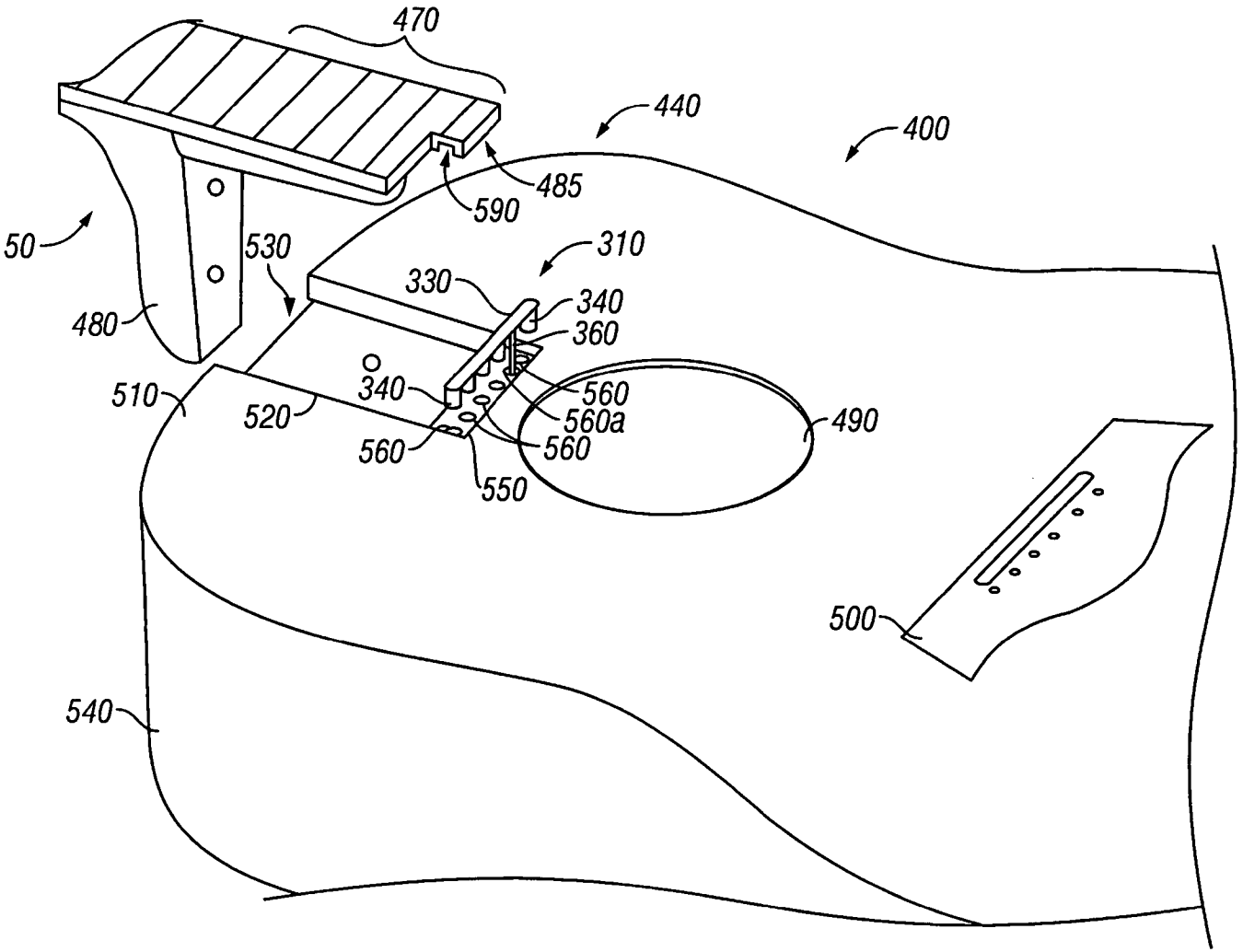
FIG. 6 is a perspective view of a musical instrument including the string sensor of FIGS. 5A and 5B.
Figure 7:
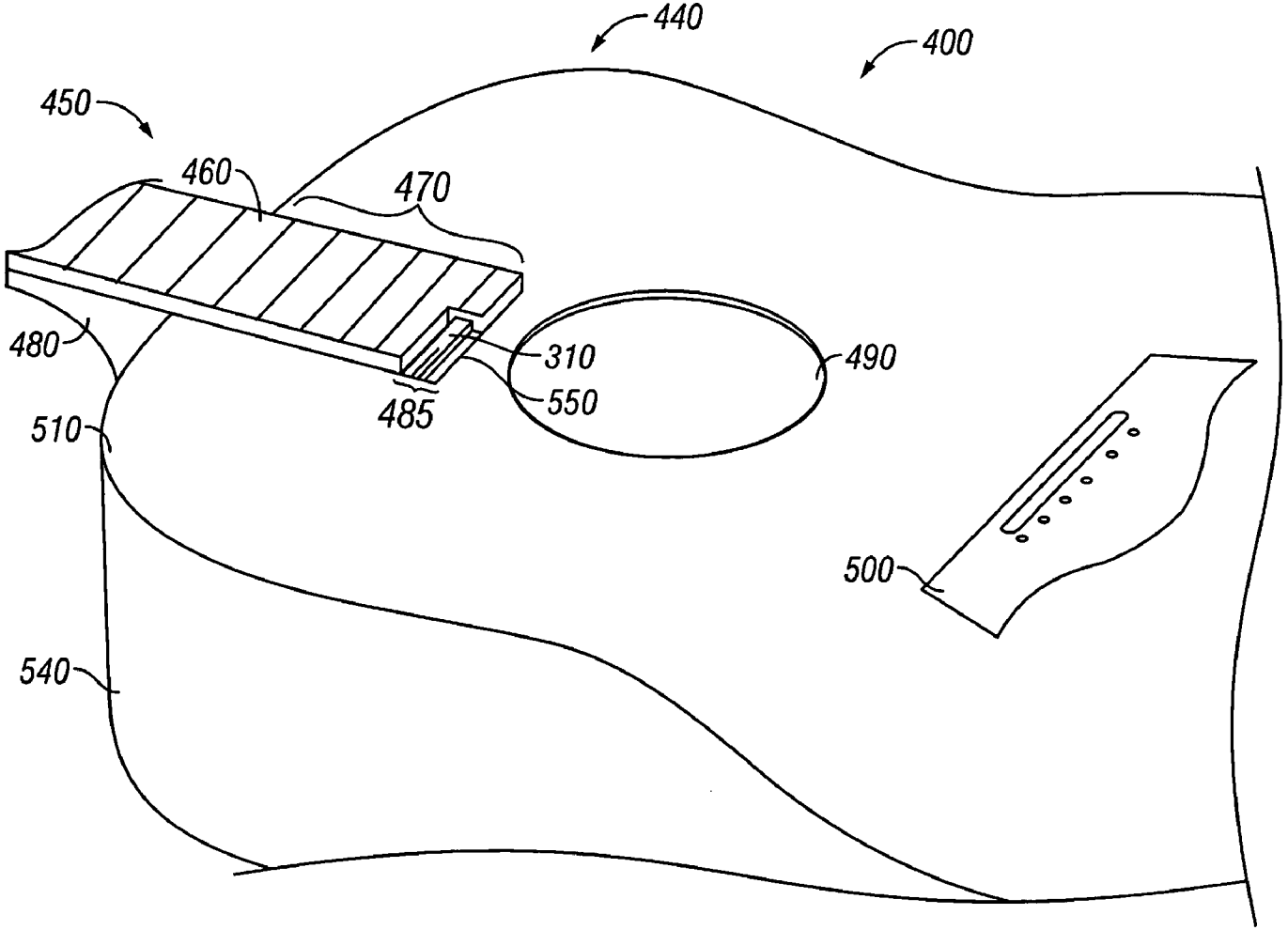
FIG. 7 is a perspective view of a musical instrument including the string sensor of FIGS. 5A and 5B.

FIGS. 6 and 7 show an acoustic guitar 400 incorporating the preferred string sensor 310 of the present invention. Guitar 400 comprises a body portion 440 and a neck portion 450 including a fret board 460, a tail 470 and a heel 480. A portion of the fret board located at a distal end 485 of the tail 470 has been removed to help illustrate some of the features of the present invention. The guitar body portion 440 comprises a hollow body including a sound port 490 and bridge 500 on its top surface 510. In addition, the body portion 440 includes a pair of recesses 520,530 in the top 510 and side 540 surfaces, respectively, for attachment of the neck portion 450. More particularly, the tail 470 mates with recess 520 and the heel 480 mates with recess 530.

Suitable means for attaching the neck portion 450 to the body portion 440 include fasteners that pass from the internal cavity of the body portion 440 into the tail 470 and heel 480 as disclosed in U.S. Pat. No. 6,051,766 to Taylor, which is hereby incorporated by reference in its entirety. Advantageously, adhesives such as glue are not used to attach the neck portion 450 so that the neck can be readily detached from the body portion 440 permitting access to the string sensor 310.

As best seen in FIG. 6, the top surface 510 includes a recessed area 550 dimensioned to receive electromagnetic string sensor 310. Recessed area 550 is disposed between recess 520 and sound port 490. As shown in FIG. 7, when the guitar 400 is fully assembled, the string sensor 310 is disposed beneath the fretboard 460 such that it hidden from view, thus providing a more aesthetically pleasing appearance. The string sensor 310 can be easily accessed for repair or replacement by removing the neck portion 450 from the body portion 440.

Referring again to FIG. 6, recessed area 550 includes a plurality of apertures 560 dimensioned to receive pole pieces 340. In the illustrated embodiment, there are five circular apertures 340 corresponding to the five pole pieces 340. The recessed area 550 optionally includes an additional aperture 560*a* that can be used for the passage of lead wires 580 or additional pole pieces, if applicable. In addition, the interior surface of the distal end 485 of the tail 470 includes a cut out 590 dimensioned to receive bobbin 330. As shown in FIG. 7, when neck portion 450 is attached to body portion 440, the fretboard 460 obscures the presence of string sensor 310 making it virtually invisible.

Electromagnetic Sensor Array for a Musical Instrument

Figure 8A:
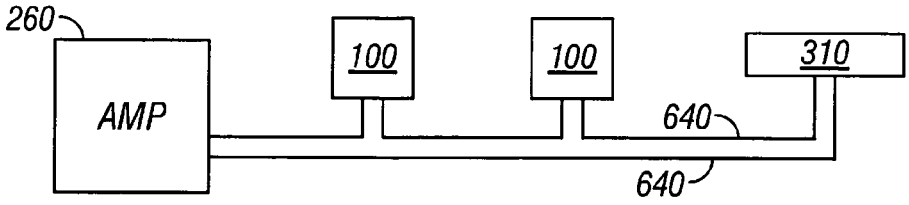
Figure 8B:
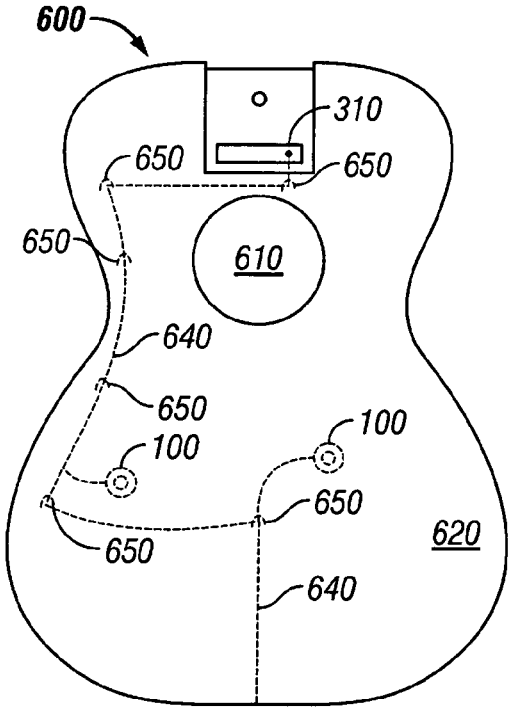
FIGS. 8B and 8C are top plan views of an exterior and interior surface, respectively, of a soundboard of a musical instrument including a sensor array in accordance with the principles of the present invention.
Figure 8C:
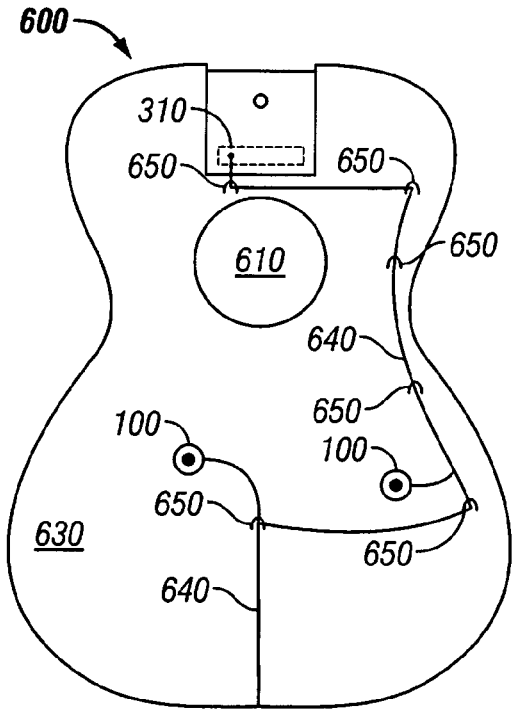

FIG. 8A is a schematic wiring diagram depicting string sensor 310 and a pair of body sensors 100 coupled in series by lead 640. The electric signal transduced in the string sensors and body sensors is sent by lead 640 out to amplifier 260. Although a preferred string sensor 310 and body sensors 100 are described hereinabove, it should be apparent to those of ordinary skill in the art that other suitable string and body sensors may be employed without departing from the scope of the present invention FIGS. 8B and 8C show an acoustic guitar soundboard 600 including sound port 610 and an array of electromagnetic sensors 100,310 connected in series in accordance with the principles of the present invention. More particularly, FIG. 8B shows a top plan view of the exterior surface 620 of soundboard 600 and FIG. 8C shows a top plan view of the interior surface 630 of soundboard 600. The sensor array is adapted to pick up vibrational energy at separate and distinct locations on the guitar soundboard and convert the combined vibrational energy into electrical signals for amplification. As will be appreciated by those of skill in the musical arts, the electromagnetic sensor array can be used with other stringed musical instruments, including, but not limited to, violins, cellos, basses, sitars, mandolins and violas, without departing from the scope of the present invention.

Referring to FIGS. 8B and 8C, in a preferred embodiment, the electromagnetic sensor array comprises string sensor 310 and a pair of body sensors 100 coupled in series by lead 640. Lead 640 is attached to the interior surface of soundboard 600 using suitable fasteners such as U-shaped tacks 650. Advantageously, the body sensors and leads 640 are substantially hidden form view during use of the guitar. Lead 640 provides a path for the electric signal to get to external components such as an amplifier and speaker. In the illustrated embodiment, there is only one lead because there is no "baseline" current or voltage that is externally supplied to sensors 100,310 such that an outside power source is not required. Advantageously, the sensors of the present invention require no power to operate since they rely on energy created by movement of the soundboard and strings. By contrast, piezocrystals require a preamplifier to function properly. In addition, sensors 100,310 do not produce the undesirable native sound and distortion associated with piezocrystals.

Referring again to FIGS. 1 and 2, body sensors 100 are preferably electromagnetic transducers including housing 110, coil 120, lead 140, permanent magnet 150, gasket 160, cap 170 and leaf spring diaphragm 180. In addition, body sensors 100 preferably include the polar orientation shown by reference characters "N" and "S" in FIG. 1, wherein cylindrical permanent magnet 150 is constructed to have one south pole and one north pole disposed symmetrically about central axis H. As described above, this polar orientation is preferable because it takes advantage of linear and rotational aspects of the vibration. Alternatively, body sensors 100 may include other polar orientations such as having the north and south poles disposed at the ends of the cylindrical magnet.

As disclosed above, developing material technologies may make possible more powerful magnets having new magnet geometries. For example, it may be or become possible to make a cylindrical magnet with 2 north poles and 2 south poles alternating about the central axis or a magnet with more than 4 total poles. Such magnets would be especially useful in conjunction with the rotating vibration aspect of body sensors 100 and the resultant electric signal induced in the coil would tend to be stronger and also would tend to have a different quality than a conventional linear motion transducer.

Body sensors 100 are attached to the soundboard such that the bottom surface of cap 170 is substantially flush with the interior surface of soundboard 600. One suitable attachment means is a thin layer of adhesive between the cap and the soundboard. Alternatively, the body sensors may be attached using convention fasteners such as screws, nails, tacks or VELCRO. All body sensors 100 are preferably attached to the interior surface of soundboard 600 such that they are substantially oriented in a single direction.

As best seen in FIG. 8B, body sensors 100 are separated by a considerable distance (i.e., a distance greater than the diameter of sound port 610). Since different areas of the soundboard produce different vibrations and sounds when the guitar is played, it is preferred that the sensors are located in distinct and separate areas in order to pick up a broader range of acoustic expression. In operation, the body sensors interact physically with each other such that the combination of body sensors produces a different sound than would the sum of the body sensors.

Choosing the exact location on the soundboard for the body sensors for a particular guitar is not an exact science, but rather an exercise in trial and error. Guitar soundboards include natural body movement areas or hot spots, which are vibration points that tend to reflect the same frequency and tonal quality of the guitar as one hears directly. The body sensors of the present invention are adapted to pick up overtones by the guitar strings interacting with the soundboard. Preferably, body sensors 100 should be strategically placed on the soundboard adjacent the hot spots. However, this may require a significant amount of testing. In other words, each body sensor 100 should be moved about different locations on the interior surface of soundboard 600 in order to locate hot spots that result in the production of a sound through an electronic amplifier similar to that which one hears directly.

The placement of body sensors 100 should also take advantage of the natural phase relationship of the soundboard. At times, the body sensors will cancel each other out, which is an acceptable result since certain guitar sounds naturally cancel each other out. Proper placement of the body sensors will reduce phase problems that may cause feedback at high volumes. Locating areas on the soundboard that result in a reduction of phase problems also requires some trial and error.

Referring again to FIGS. 5-7, string sensor 310 preferably comprises a bobbin 330, coil 350 and at least one pole piece 340, wherein each pole piece 340 is adapted to be disposed substantially adjacent a respective guitar string. In operation, the vibration of the strings causes changes in the magnetic fields of the pole pieces 340, which in turn induces current in the coil 350. The induced current is then fed to conventional amplifying equipment through lead 640. When the guitar is fully assembled, the string sensor 310 is disposed between the fretboard and the guitar body such that it is obscured from view. String sensor 310 works in concert with body sensors 100 to add balanced string input to the guitar's overall sound.

As shown in FIGS. 8A and 8B, in the illustrated embodiment, the sensor array includes a pair of body sensors 100 and a single string sensor 310. However, as would be appreciated by those of skill in the art, any number of body and string sensors may be employed without departing from the scope of the present invention. By way of example, the sensor array may comprise a single string sensor 310 and any number of body sensors 100, including, but not limited to 1, 2, 3,4, 5, 6, 7, 8, 9 and 10 body sensors, wherein each body sensor located at a separate and distinct location on the interior surface of soundboard 600. Ideally, the sensor array will include body sensors located at as many distinct locations on the soundboard as possible. However, such an arrangement would require perhaps hundreds of individual body sensors and would, therefore, be prohibitively expensive. As a further example, the sensor array may include a plurality of body sensors 100 connected in series without a string sensor 310. Conversely, the sensor array may consist of a plurality of string sensors 310 connected in series without a body sensor 100.

Thus, it is seen that a sensor array for a musical instrument is provided. One skilled in the art will appreciate that the present invention can be practiced by other than the various embodiments and preferred embodiments, which are presented in this description for purposes of illustration and not of limitation, and the present invention is limited only by the claims that follow. It is noted that equivalents for the particular embodiments discussed in this description may practice the invention as well.

What is claimed is:

1. A sensor array for an acoustic musical instrument having strings and a hollow body including a soundboard, the sensor array comprising:

a string sensor disposed adjacent the strings; and at least one body sensor comprising a permanent magnet disposed adjacent a coil and configured to move relative to the coil, wherein the at least one body sensor is configured such that linear displacement of the magnet relative to the coil causes the magnet to rotate relative to the coil, wherein the at least one body sensor is configured to be attached to the soundboard of the hollow-bodied instrument; and wherein the string sensor and at least one body sensor are connected in series by a lead.

2. The sensor array of claim 1, wherein a plurality of body sensors are oriented substantially in the same direction.

3. The sensor array of claim 1, wherein each body sensor is attached at a distinct location on the soundboard.

4. The sensor array of claim 3, wherein a plurality of body sensors are attached to the soundboard such that the output of at least two of the body sensors are out of phase at a predetermined frequency.

5. The sensor array of claim 1, wherein the string sensor and at least one body sensor are wired to an amplifier.

6. The sensor array of claim 1, wherein the at least one body sensor is attached to an interior surface of the soundboard such that the at least one body sensor is substantially hidden from view during use of the musical instrument.

7. The sensor array of claim 1, wherein the string sensor and at least one body sensor are powered by energy created by the movement of the strings and soundboard such that an external power source is unnecessary.

8. The sensor array of claim 1, wherein the musical instrument is a guitar.

9. The sensor array of claim 1, wherein the at least one body sensor further comprises a housing and a diaphragm.

10. The sensor array of claim 9, wherein the transducer further comprises damping fluid filling the housing and substantially surrounding the magnet.

11. The sensor array of claim 10, wherein the damping fluid is adapted to damp external vibrations that cause the magnet to vibrate.

12. The sensor array of claim 9, wherein the housing includes a bobbin portion that constrains the coil to the housing.

13. The sensor array of claim 9, wherein the magnet is substantially cylindrical and includes a central longitudinal axis.

14. The sensor array of claim 13, wherein the magnet includes poles that are disposed substantially symmetrically about the central longitudinal axis such that the poles form semi-cylindrical portions of the magnet.

15. The sensor array of claim 9, wherein the diaphragm is attached to one end of the magnet.

16. The sensor array of claim 1, wherein the string sensor is an electromagnetic pickup comprising: a bobbin; a coil wound around the bobbin; and at least one permanent magnet coupled to the bobbin.

17. The sensor array of claim 16, wherein each magnet is disposed substantially adjacent a respective musical instrument string.

18. The sensor array of claim 16, wherein each magnet is substantially cylindrical.

19. The sensor array of claim 16, wherein the string sensor further comprises an elongate metal bar embedded within the bobbin.

20. A sensor array for a musical instrument having strings and a soundboard, the sensor array comprising:

a string sensor disposed adjacent the strings; and at least one body sensor attached to the soundboard; wherein the string sensor and at least one body sensor are connected in series by a lead;

wherein each body sensor is an electromagnetic transducer comprising a housing, a coil, a permanent magnet and a diaphragm;

wherein the diaphragm is attached to one end of the magnet; and wherein the diaphragm is a thin disk-shaped leaf spring comprising a first end portion and a second end portion; and displacement of the second end portion away from the first end portion in a linear direction along a linear axis will tend to cause the second end portion to rotate with respect to the first end portion about a rotational axis.

21. The sensor array of claim 9, wherein the magnet is disposed within the housing.

22. The sensor array of claim 21, wherein the vibration of the magnet induces current changes in the coil.

23. A sensor array for an acoustic musical instrument having strings and a hollow body including a soundboard, the sensor array comprising:

a plurality of body sensors wherein at least one of the plurality of body sensors comprises a permanent magnet disposed adjacent a coil and configured to move relative to the coil, wherein the at least one body sensor is configured such that linear displacement of the magnet relative to the coil causes the magnet to rotate relative to the coil, and wherein the plurality of body sensors are connected in series, attached to the soundboard of the hollow body and oriented substantially in a single direction.

24. The sensor array of claim 23, wherein the sensors are attached at distinct locations on the soundboard.

25. The sensor array of claim 23, wherein the plurality of sensors are attached to an interior surface of the soundboard.

26. The sensor array of claim 23, wherein the plurality of sensors are powered by energy created by the movement of the strings and soundboard such that an external power source is unnecessary.

27. The sensor array of claim 23, wherein the musical instrument is a guitar.

28. The sensor array of claim 23, wherein each sensor further comprises a housing and a diaphragm.

29. The sensor array of claim 28, wherein the transducer further comprises damping fluid filling the housing and substantially surrounding the magnet.

30. The sensor array of claim 29, wherein the damping fluid is adapted to damp external vibrations that cause the magnet to vibrate.

31. The sensor array of claim 28, wherein the magnet is substantially cylindrical and includes a central longitudinal axis.

32. The sensor array of claim 31, wherein the magnet includes poles that are disposed substantially symmetrically about the central longitudinal axis such that the poles form semi-cylindrical portions of the magnet.

33. The sensor array of claim 28, wherein the magnet is disposed within the housing.

34. The sensor array of claim 33, wherein the vibration of the magnet induces current changes in the coil.

35. A sensor array for an acoustic musical instrument having strings and a hollow body including a soundboard, the sensor array comprising:

a plurality of body sensors wherein at least one of the plurality of body sensors comprises a permanent magnet disposed adjacent a coil and configured to move relative to the coil, wherein the at least one body sensor is configured such that linear displacement of the magnet relative to the coil causes the magnet to rotate relative to the coil, wherein the plurality of body sensors are connected in series and attached at distinct locations on the soundboard of the hollow body; and wherein each body sensor is attached to the soundboard adjacent a soundboard hot spot.

36. The sensor array of claim 35, wherein the sensors are powered by energy created by the movement of the strings and soundboard such that an external power source is unnecessary.

37. The sensor array of claim 35, wherein the musical instrument is a guitar.

38. The sensor array of claim 35, further comprising at least one string sensor disposed substantially adjacent the strings.

39. The sensor array of claim 35, wherein the body sensors are attached to an interior surface of the soundboard such that they are substantially hidden from view during use of the musical instrument.

40. The sensor array of claim 35, wherein each body sensor further comprises a housing and a diaphragm.

41. The sensor array of claim 40, wherein the transducer further comprises damping fluid filling the housing and substantially surrounding the magnet.

42. The sensor array of claim 40, wherein the magnet is substantially cylindrical and includes a central longitudinal axis; and the magnet includes poles that are disposed substantially symmetrically about the central longitudinal axis such that the poles form semi-cylindrical portions of the magnet.

43. The sensor array of claim 40, wherein the magnet is disposed within the housing; and the vibration of the magnet induces current changes in the coil.

44. The sensor array of claim 35, further comprising a plurality of string sensors disposed substantially adjacent the strings.

45. The sensor array of claim 44, wherein each string sensor is an electromagnetic pickup comprising: a bobbin; a coil wound around the bobbin; and at least permanent magnet coupled to the bobbin.

46. The sensor array of claim 45, wherein each magnet is disposed substantially adjacent a respective musical instrument string.

47. The sensor array of claim 45, wherein each magnet is substantially cylindrical.

* * * * *